US005140794A

United States Patent [19]

Miller

[11] Patent Number: 5,140,794

[45] Date of Patent: Aug. 25, 1992

[54] FORMING SYSTEM FOR HARDENING MATERIAL

[75] Inventor: Brian J. Miller, McHenry, Ill.

[73] Assignee: Foam Form Systems, Inc., McHenry, Ill.

[21] Appl. No.: 526,228

[22] Filed: May 18, 1990

Related U.S. Application Data

[63] Continuation-in-part of Ser. No. 247,038, Sep. 20, 1988, Pat. No. 4,972,646, which is a continuation-in-part of Ser. No. 167,782, Mar. 14, 1988, abandoned.

[51] Int. Cl.[5] ..... E04B 2/44; E04C 2/26

[52] U.S. Cl. ..... 52/309.12; 52/426; 52/562

[58] Field of Search ..... 52/426, 427, 428, 562, 52/563, 564, 565, 309.12, 405, 245, 249

[56] References Cited

U.S. PATENT DOCUMENTS

| | | | |
|---|---|---|---|
| 1,692,167 | 11/1928 | Gates . | |
| 1,702,672 | 2/1929 | Toogood . | |
| 1,800,802 | 4/1931 | Miller . | |
| 2,078,144 | 4/1937 | Kenan | 52/565 |
| 2,095,714 | 10/1937 | Pinaud et al. . | |
| 2,413,415 | 12/1946 | Olson . | |
| 3,325,198 | 6/1967 | Cruse . | |
| 4,034,950 | 7/1977 | Powell . | |
| 4,133,156 | 1/1979 | Unger . | |
| 4,516,372 | 5/1985 | Grutsch . | |
| 4,750,308 | 6/1988 | McKay . | |
| 4,773,199 | 9/1988 | Koharu . | |
| 4,864,792 | 9/1989 | Andre | 52/428 |
| 4,901,494 | 2/1990 | Miller | 52/562 |
| 4,972,646 | 11/1990 | Miller | 52/309.15 |

FOREIGN PATENT DOCUMENTS

| | | |
|---|---|---|
| 166155 | 11/1955 | Australia . |
| 1037105 | 8/1958 | Fed. Rep. of Germany . |
| 1484201 | 4/1969 | Fed. Rep. of Germany . |
| 1271208 | 1/1962 | France . |

*Primary Examiner*—John E. Murtagh
*Attorney, Agent, or Firm*—Leydig, Voit & Mayer

[57] ABSTRACT

A forming system for a hardenable material is provided having a form unit including a pair of wall panels arranged in a predetermined upright spaced relation and a skeletal grid assembly disposed therebetween. The skeletal grid assembly includes locking means for interconnecting with a grid assembly of a second form unit of like construction and disposed in side by side relation therewith.

21 Claims, 6 Drawing Sheets

FORMING SYSTEM FOR HARDENING MATERIAL

This is a continuation-in-part of my application Ser. No. 247,038 filed Sep. 20, 1988 now U.S. Pat. No. 4,972,646 and now allowed, which is a continuation-in-part of my application Ser. No. 167,782 filed Mar. 14, 1988 and now abandoned.

BACKGROUND OF THE INVENTION

The most common method of erecting concrete walls and foundations today utilizes forms constructed of plywood and timber framing. Reinforcement can be provided by installing rebar or other metal reinforcement in the space between the forms. In many installations, metal reinforcement is installed prior to building the forms. After the space is filled with concrete and the concrete is allowed to set, the wooden forms are removed.

This type of procedure has proved to be expensive for a variety of reasons. The wood itself is expensive. Due to the density of the wood, transportation to the construction site is quite costly. In addition, qualified carpenters are needed to erect the wooden forms. Furthermore, workers must later come back after the concrete is poured to remove the forms. There are also seasonal costs when the concrete is poured during cold weather because the wood forms must be insulated by applying blankets to the exposed sides and straw to the exposed surface of the concrete.

Heretofore, concrete forms of expanded polystyrene or extruded polystyrene foam have been utilized. Such foam is lightweight and, therefore, inexpensively transportable to the construction site. Such foam forms provide thermal insulation during pouring and can be left in place after the concrete is poured in order to eliminate the cost of removal and to provide insulation to the area defined by the concrete walls. Systems incorporating these features are described in our copending applications Ser. No. 167,782 filed Mar. 14, 1988 and Ser. No. 247,038 filed Sep. 20, 1988 and are incorporated herein by reference.

SUMMARY OF THE INVENTION

One advantage of such forms constructed according to this invention is that it is easier to cut out openings for additional form work when creating openings in the foundation.

A further advantage of the improved system is that it allows for accurate and precise coupling of multiple form units which can be adjusted to define selected curved configurations.

The present invention also provides a concrete forming system having a plurality of form units with interlocking means which facilitate multiple attachment of the units in a manner which allows for accurate and precise unit alignment.

The improved system embodies improved retaining means utilizing cross rods in a manner such that the cross rods may be constructed of smaller diameter wire thereby decreasing material costs without loss of structural integrity.

The improved forming system includes a grid assembly which is adjustable to allow for specific linear requirements.

The grid assembly of the improved forming system may be constructed in a curved or non-planar manner so that various geometric shapes can be attained.

In summary, there is provided a unitary concrete forming system comprising at least one form unit having upright spaced-apart first and second wall panels of foam plastic material. Each wall panel has an interior surface and an exterior surface, with a plurality of holes interconnecting the surfaces thereof. The holes in the first wall panel are laterally aligned with corresponding holes in the second wall panel. Disposed between the spaced wall panels is a skeletal grid assembly which incorporates a plurality of laterally extending first rods, each spanning the distance between the wall panels and having opposite end portions thereof disposed within laterally aligned holes and extending at a predetermined angle relative to the interior surfaces of the wall panels. A plurality of longitudinally extending second rods are attached to at least some of the first rods and are disposed against the interior surfaces of the wall panels. A plurality of longitudinally extending third rods, disposed between and parallel to said second rods and are attached to at least some of the first rods. A plurality of complementary interlocking means are located on at least one end of the second and third rods and effect multiple, precise interconnection of adjacent form units. A plurality of retaining means engage the end portions of the first rods disposed at the exterior surfaces of the wall panels and interconnect the ends of at least two first rods to firmly sandwich the wall panels between the retaining means and the respective second rods. The grid assembly may be constructed so as to allow on-site linear adjustments or formation of arcuate shapes.

After assembly of the concrete forming system, the exterior surfaces of the wall panels may be coated with a moisture impervious sheet or coating.

The novel and unique features of the invention will become apparent from the description, drawings, and appended claims; it being understood, however, that various changes in the details of construction, combination, and arrangement of parts may be made without departing from the spirit of the present invention.

BRIEF DESCRIPTION OF THE DRAWINGS

For the purpose of facilitating an understanding of the invention, reference is made to the accompanying drawings wherein.

DETAILED DESCRIPTION OF PREFERRED EMBODIMENTS

Figure 1:
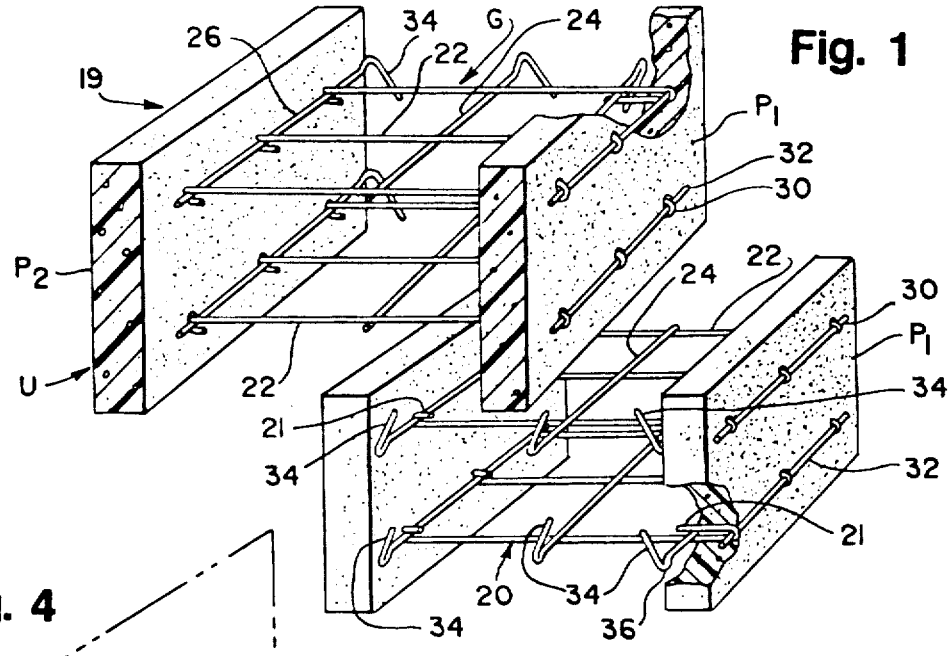
FIG. 1 is a perspective, fragmentary view depicting two forming units of one embodiment of the improved concrete forming system prior to interconnection.
Figure 2:
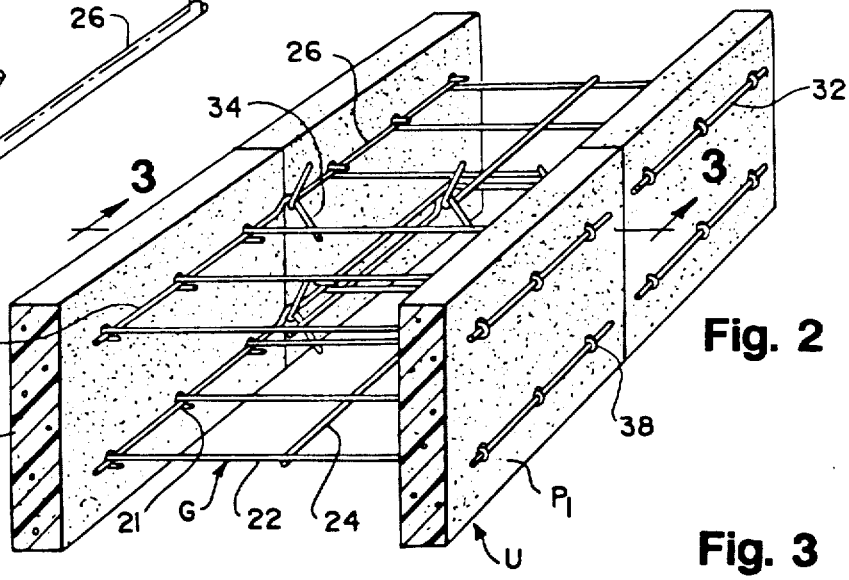
FIG. 2 is similar to FIG. 1 but showing the form units interlockingly engaged.

Referring now to FIGS. 1 and 2, there is depicted one embodiment of the improved concrete forming system 19 showing but one of a plurality of interconnecting form units U incorporated therein. Each unit U comprises a pair of wall panels $P_1$ and $P_2$ of polystyrene foam or another material having similar characteristics. The wall panels (e.g. 4' × 8') are usually disposed in upright, spaced, normally parallel relation. The foam material possesses highly desirable features such as being lightweight, yet rigid and providing good thermal insulation. Each panel is normally of quadrilateral configuration.

The improved forming system 19 is provided with a grid system G which is disposed between the pair of wall panels. The grid assembly retains the wall panels in a predetermined upright, spaced, parallel relation when a hardenable material (e.g. concrete) is being poured therebetween and provides a reinforcement for such material when it hardens. The grid system G includes a predetermined number of skeletal grid assemblies 20. Each grid assembly 20 includes a plurality of elongate rods 22, 24, and 26, which are preferably formed of ten-gauge steel wire.

Rods 22, hereinafter referred to as cross rods or first rods, span the distance between the pair of wall panels and are angularly disposed (e.g. perpendicular) to the interior surfaces thereof. The cross rods 22 are preferably in horizontally spaced parallel relation and positioned on 4" centers. The cross rods are retained in the desired relative positions by a plurality of rods 24 and 26, which either overlie or underlie the cross rods and are affixed thereto by welding or the like. Second rods 26, sometimes referred to as outer rods, are disposed against the interior surfaces of the wall panels. As seen in FIGS. 1 and 2, a plurality of grid assemblies can be arranged to form horizontally disposed layers with each layer having a pair of outer rods 26, intermediate or center rods 24 and a plurality of cross rods 22. The rods 24, 26 for each layer are preferably affixed to all the cross rods 22 included in the layer. The grid assemblies making up the grid system are preferably on 4" vertical centers.

Each wall panel $P_1$, $P_2$ has formed therein a plurality of holes each of which extends from the interior surface to the exterior surface of the panel. The holes are normally arranged in a predetermined pattern with corresponding holes in the panels being in laterally or horizontally aligned relation when the wall panels are in their upright, spaced relation.

Each cross rod 22 has opposite end portions which are bent so as to form reentrant portions 21. Each reentrant portion has a bail or loop segment 30 which projects outwardly from the exterior surface of the wall panel in which the reentrant portion is disposed. The free or distal end of each reentrant portion 21 may be attached to the main or central body portion of the cross rod 22 by any appropriate means such as welding; thereby reinforcing the cross rod and allowing same to be constructed of twelve or thirteen gauge steel wire. A plurality of protruding bail segments 30 are interlockingly engaged by an exposed retaining rod 32, which passes therethrough and snugly engages the wall panel exterior surface. Thus, each wall panel is firmly sandwiched between the outer rods 26 and the retaining rods 32. The sandwich arrangement provides for a secure interconnection between a grid assembly 20 and the wall panels $P_1$, $P_2$.

Although rods 24 and 26 are depicted as being oriented horizontally, this particular orientation is optional. Depending upon the particular needs of the installation, the system 19 may be rotated such that rods 24 and 26 extend vertically or at some other angle. In all arrangements, additional reinforcing rods, known as reinforcing bars or rebars, may be installed on site between the wall panels and in angular relation to the rods 24 and 26.

When the hardenable material such as concrete is poured, there is created substantial, outwardly directed forces; however, the skeletal grid system G and the retaining rods 32 prevent outward bending or bulging of the wall panels in response to such forces. The rods 22, 24 and 26 are relatively spaced and have small diameters so as not to impede the movement of the entrained aggregate when the concrete is being poured. Thus, no voids are formed in the hardened material.

Each wall panel normally has a thickness of about 1.5", and the panels are spaced apart about 6" to 12". The cross rods 22 as aforenoted normally are located on 4" centers.

Figure 3:
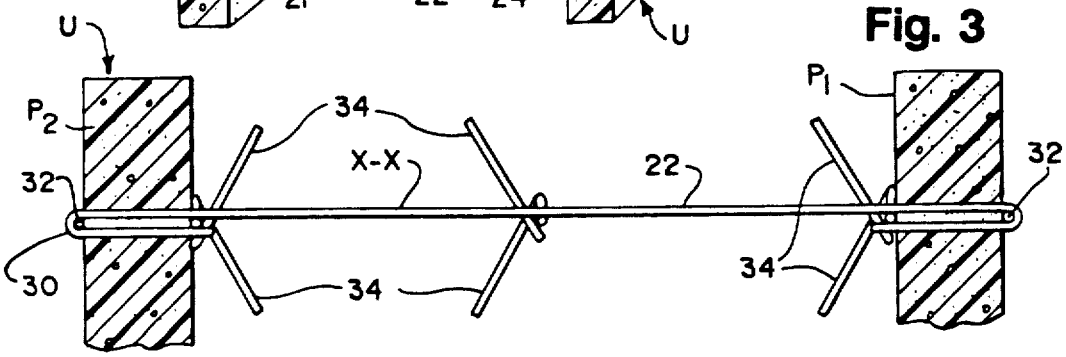
FIG. 3 is an enlarged sectional view taken along line 3—3 of FIG. 2.

FIGS. 1, 2, and 3 depict a pair of improved concrete form units U arranged horizontally in end to end relation. Complemental hook-shaped interlocking means 34, are provided at opposite ends of rods 24 and 26. The hook-shaped ends 34 extend angularly from a plane X—X defined by the cross rods 22 of the grid assembly so as to facilitate the coupling of adjacent form units U. See FIG. 3.

Figure 4:
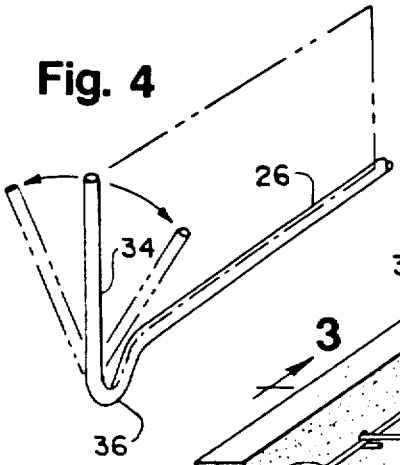
FIG. 4 is a perspective, fragmentary view of a hooked-shaped end portion of one of the grid assembly rods and illustrating in phantom lines alternative configurations.

FIG. 4 depicts an enlarged scale of various angular positions which the hook-shaped end 34 of the rod 24 or 26 may assume to effect the desired coupling. The hook-shaped end 34 may be provided with an offset notch portion 36 formed at the juncture of the end portion and main body of the rod. The notch portion facilitates proper interlocking of corresponding rods in adjacent form units U.

Figure 6:
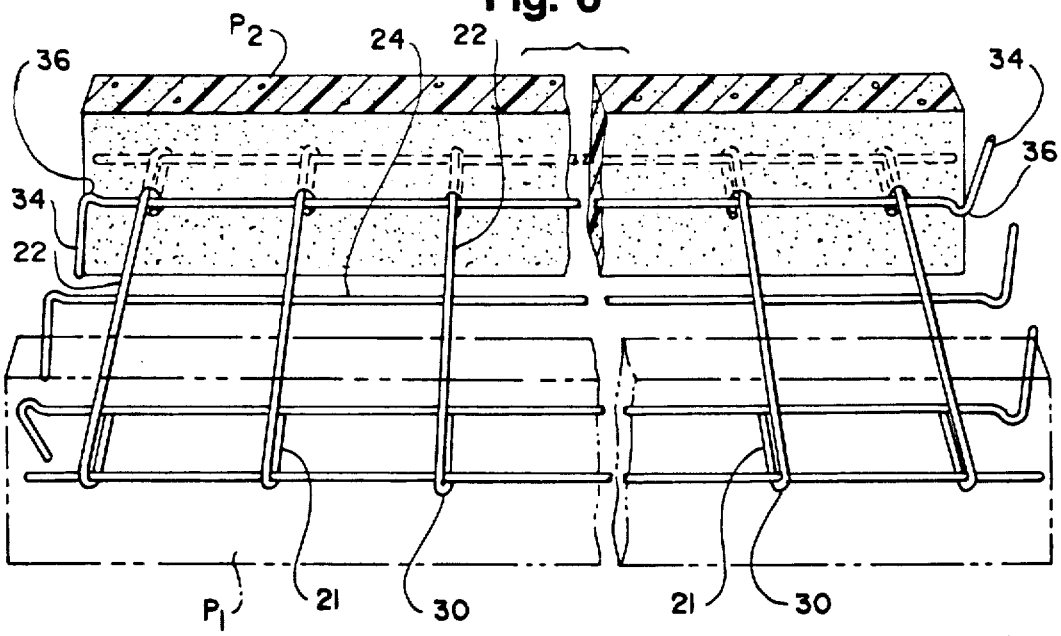
FIG. 6 is similar to FIG. 5, but showing the end portion of each assembly rod extending in opposite directions.

In the preferred embodiment, shown in FIG. 6, the hook-shaped ends 34 disposed at one end face of the wall panels extend in a direction opposite from that of the hook-shaped ends disposed at the other end face of the wall panels. Thus, adjacent form units can be readily interconnected by lowering the depending hook-shaped ends of one unit in such a manner that they will lockingly engage the upstanding hook-shaped ends of the other adjacent unit.

As shown in FIGS. 1 and 2, the hook-shaped ends 34 of the rods 24, 26 are bent inwardly away from the interior surfaces of the wall panels thereby facilitating interconnection of the ends.

For installations where the width of the wall panels of a form unit are less than the standard four feet, it is possible to engage a set of hook-shaped ends of one unit with a cross rod 22 of the other unit.

The notch portion 36 at each rod end is configured to properly accommodate either the cross rod 22 or the notch portion of both the outer rod 26 or intermediate rod 24 of an adjacent unit.

The resilience of the foam material of the abutting wall panels of adjacent units help to maintain the unit grid assemblies in interlocked relation.

Figure 5:
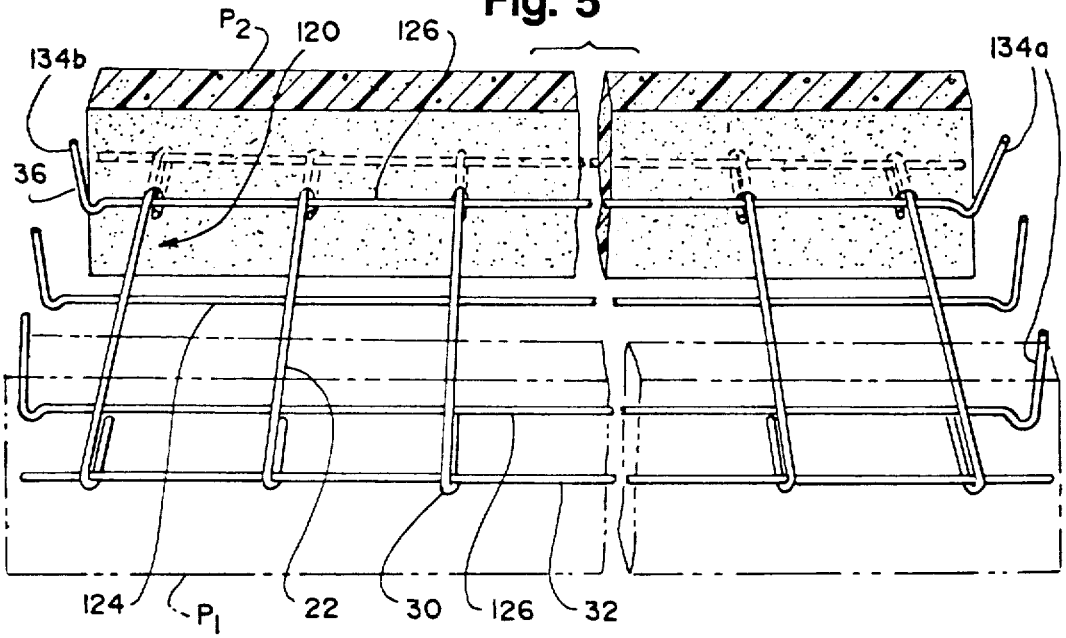
FIG. 5 is a perspective, fragmentary top view of an embodiment where the grid assembly rod end portions extend upwardly in substantially the same direction.

FIG. 5 depicts a modified grid assembly 120 wherein the rod hook-shaped ends 134*a* and 134*b* extend upwardly from the main body of the rods 124 and 126. To effect proper interlocking of adjacent grid assemblies 120, shown in FIG. 5, one of the units is inverted relative to the other so the hook-shaped ends of the adjacent units are offset in opposite directions.

FIG. 6 discloses the preferred grid assembly 20 incorporated in the system 19 of FIG. 1 and has the hooked-shaped rod ends 34 of each rod 24, 26 offset in opposite directions thereby eliminating the need for inversion of the adjacent unit.

Figure 7:
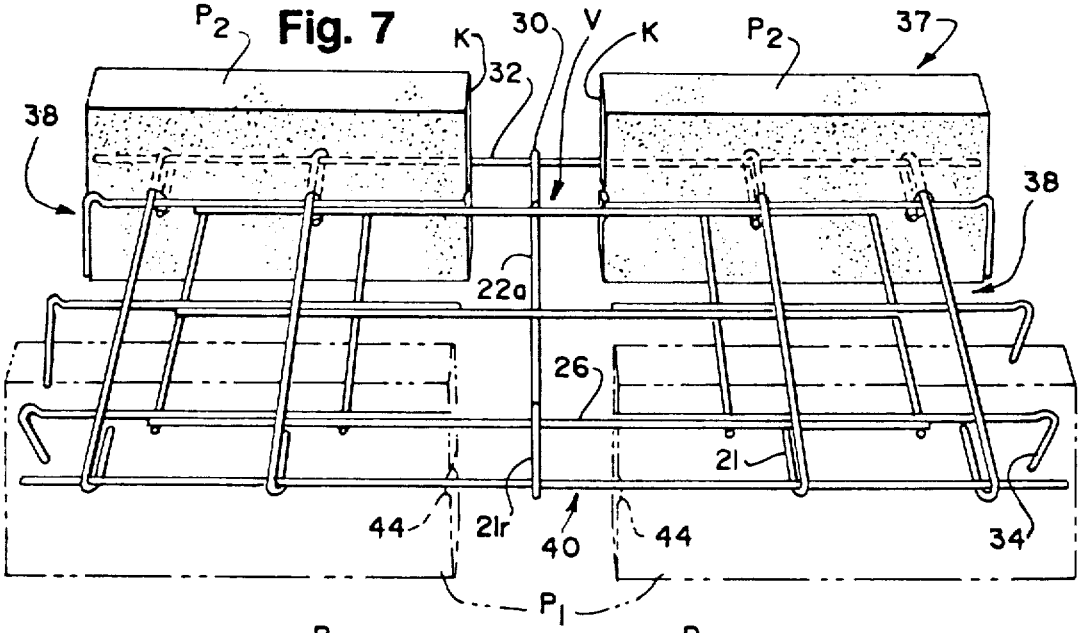
FIG. 7 is a perspective, fragmentary top view of the improved forming system incorporating a longitudinally adjustable grid assembly shown in an extended mode.
Figure 8:
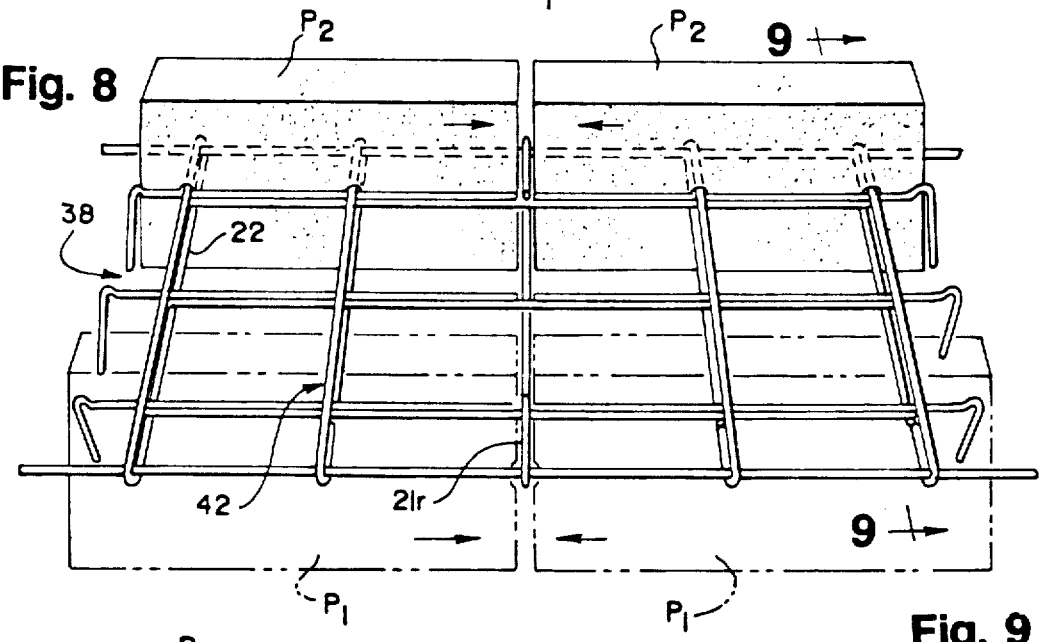
FIG. 8 similar to FIG. 7, but showing the adjustable grid assembly in a contracted mode.

An adjustable forming unit 37 is shown in FIGS. 7 and 8 which comprises first and second end-grid assemblies 38 and an intermediate or mid-grid assembly 40. Each assembly 38 or 40 includes intermediate and outer rods 24, 26 respectively, which are similar to the corresponding rods comprising grid assembly 20. Rods 24 and 26 of the mid-grid assembly 40 are disposed adjacent the respective rods 24 and 26 of the first and second end-grid assemblies 38. The distal ends of the reentrant portions 21 of each rod 22 of the end-grid assemblies 38 extend inwardly from the interior surfaces of the wall panel and cooperate with the main body of outer rod 26 to form guides 42 in which rods 26 of the mid-grid assembly 40 are slidably accommodated.

Figure 10:
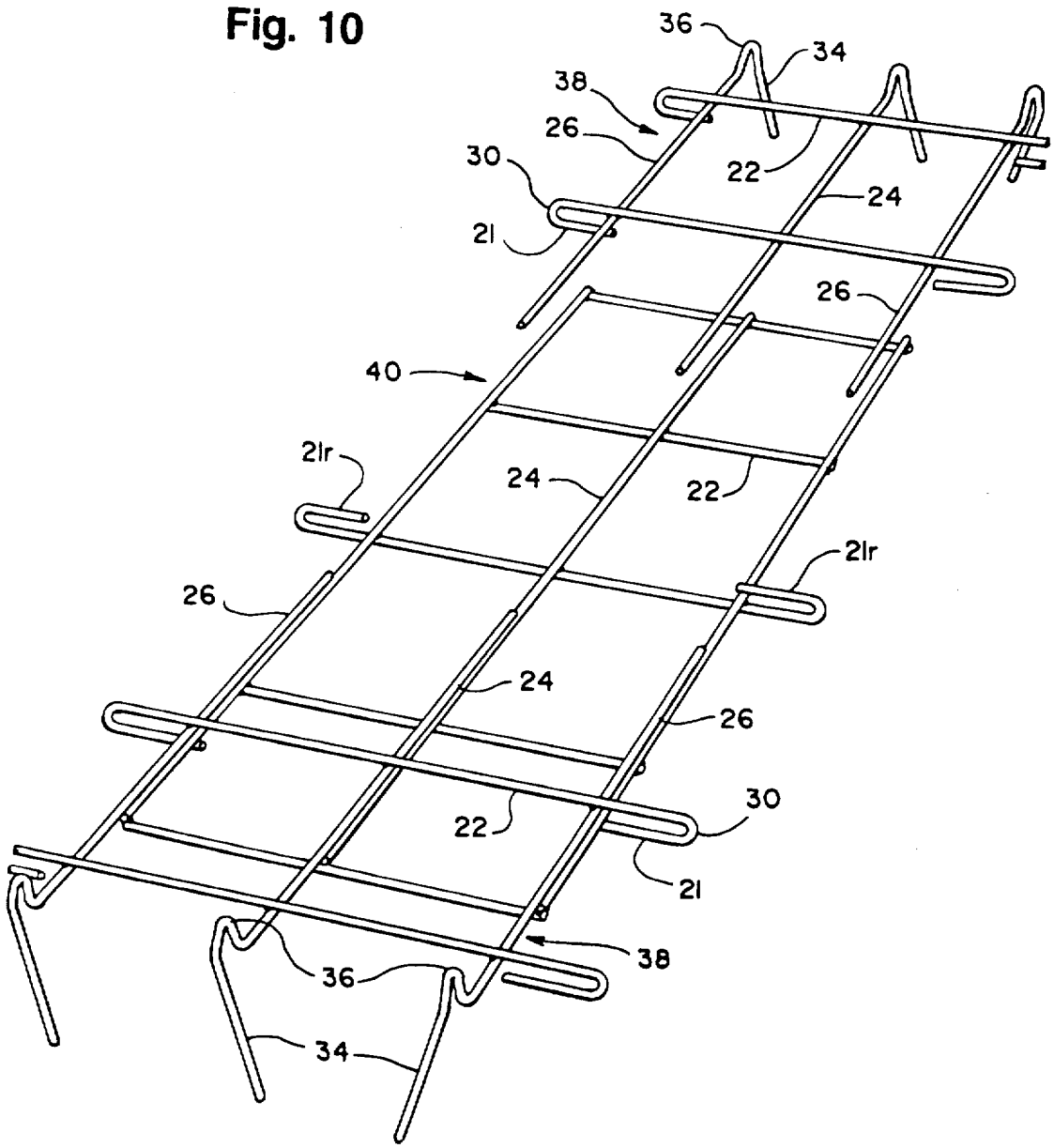
FIG. 10 is an enlarged perspective view per se of FIG. 7 and showing portions thereof in exploded relation.

In mid-grid assembly 40, the ends of rods 24 and 26 are straight rather than bent and are interconnected by transverse cross rods 22. However, the opposite ends of rods 22 are also straight and terminate at the interior surfaces of the wall panels. A centrally disposed cross rod 22*a* may be provided to interconnect rods 24 and 26 of the mid-grid assembly. The rod 22*a* is provided with reentrant portion 21r, which are disposed between the inner end faces of the wall panels of the end-grid assemblies. Each end-grid assembly 38, on the other hand, has only the ends of rods 24 and 26 disposed adjacent the outer end faces of the wall panels bent either down or up. The opposite ends of rods 24 and 26 remain unbent, see FIG. 10.

Figure 9:
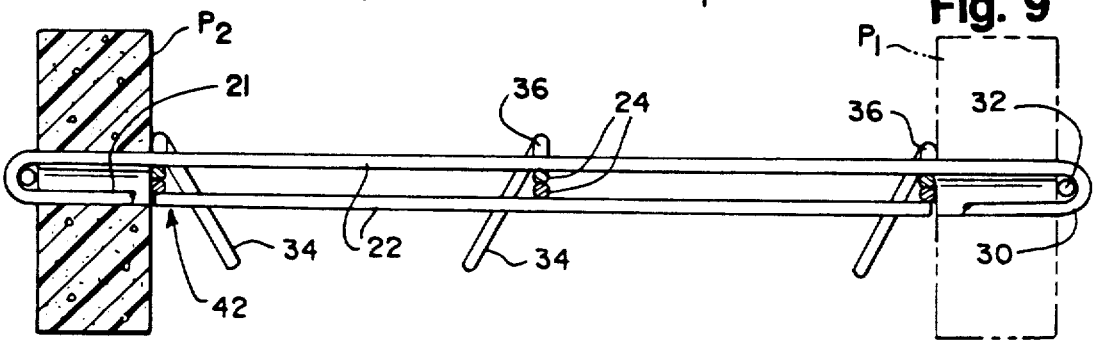
FIG. 9 is an enlarged sectional view taken along line 9—9 of FIG. 8.

FIG. 9 depicts the interrelation between the corresponding rods 24 and 26 of mid-grid assembly 40 and an end-grid assembly 38. It should be noted that the size of the guides 42 should be such as to accommodate the combined cross-sectional dimensions of the corresponding rods 26 of the mid-grid assembly and one end-grid assembly.

As seen in FIGS. 7 and 8, each end-grid assembly 38 has a pair of wall panels $P_1$, $P_2$ firmly sandwiched between the rods 26 and a retaining rod 32.

As aforenoted, the reentrant portion 21r of the center cross rod 22*a* of the mid-grid assembly 40 are disposed between the corresponding inner end faces K of the wall panels of the end-grid assemblies and are independent thereof, see FIGS. 7 and 8.

This arrangement allows one, or both of the end-grid assemblies to be slidingly adjusted along the axes of rods 24 and 26. The end faces K of wall panels $P_1$, $P_2$ have small, central complemental depressions 44 which accommodate the reentrant portions 21r of center cross rod 22*a* and allow the wall panel end faces K to be in substantial abutting relation when the adjustable unit 37 is in a fully, contracted mode, see FIG. 8. When, however, unit 37 is in an open, expanded mode, FIG. 7, strips of the foam material, not shown, are inserted into the voids V between the outer rods 26 of the mid-grid assembly 40 and the retaining rod 32.

The reentrant portions 21 have loop segments 30 which extend outwardly beyond the exterior surfaces of the wall panels. Each loop segment is sized so as to accommodate a retaining rod 32 and prevent the rod 32 from bending or bulging during the pouring of concrete. Each retaining rod 32 preferably has a length which enables it to engage the corresponding reentrant portions 30 of rods 22 which protrude from the exterior surfaces of the wall panels of the end-grid assemblies when unit 37 is in the fully expanded mode.

Figure 11:
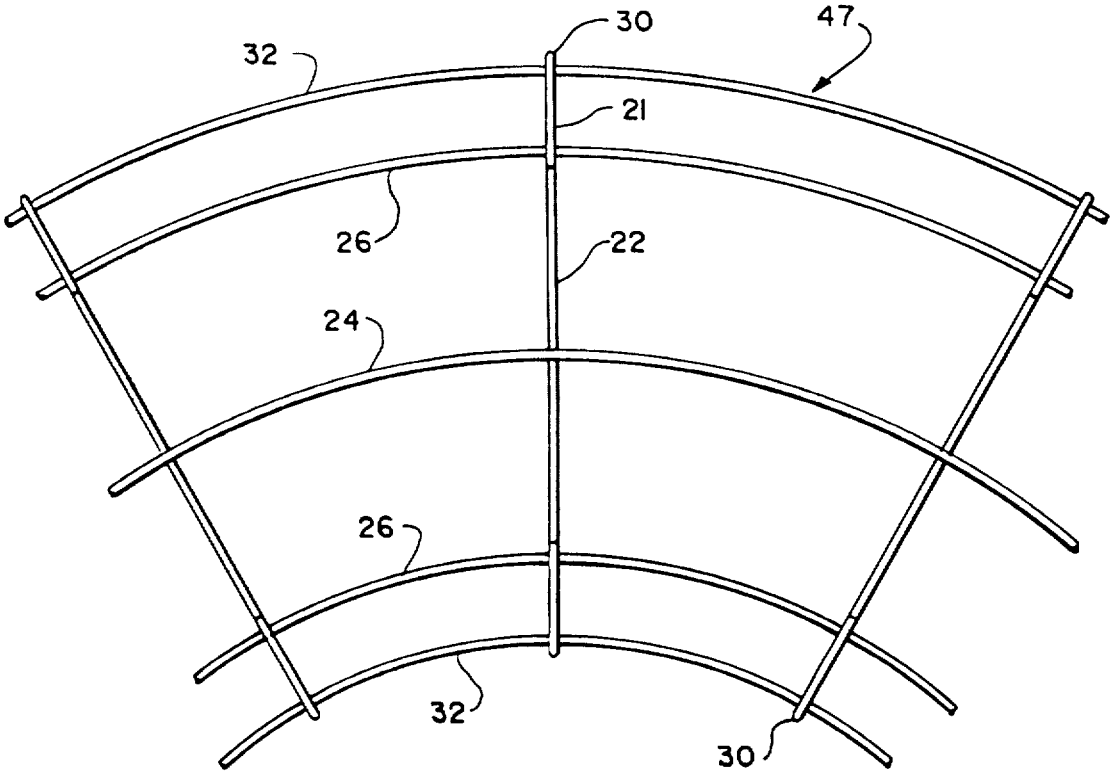
FIG. 11 is a top plan view per se of a modified grid assembly utilized in forming a curved wall.
Figure 12:
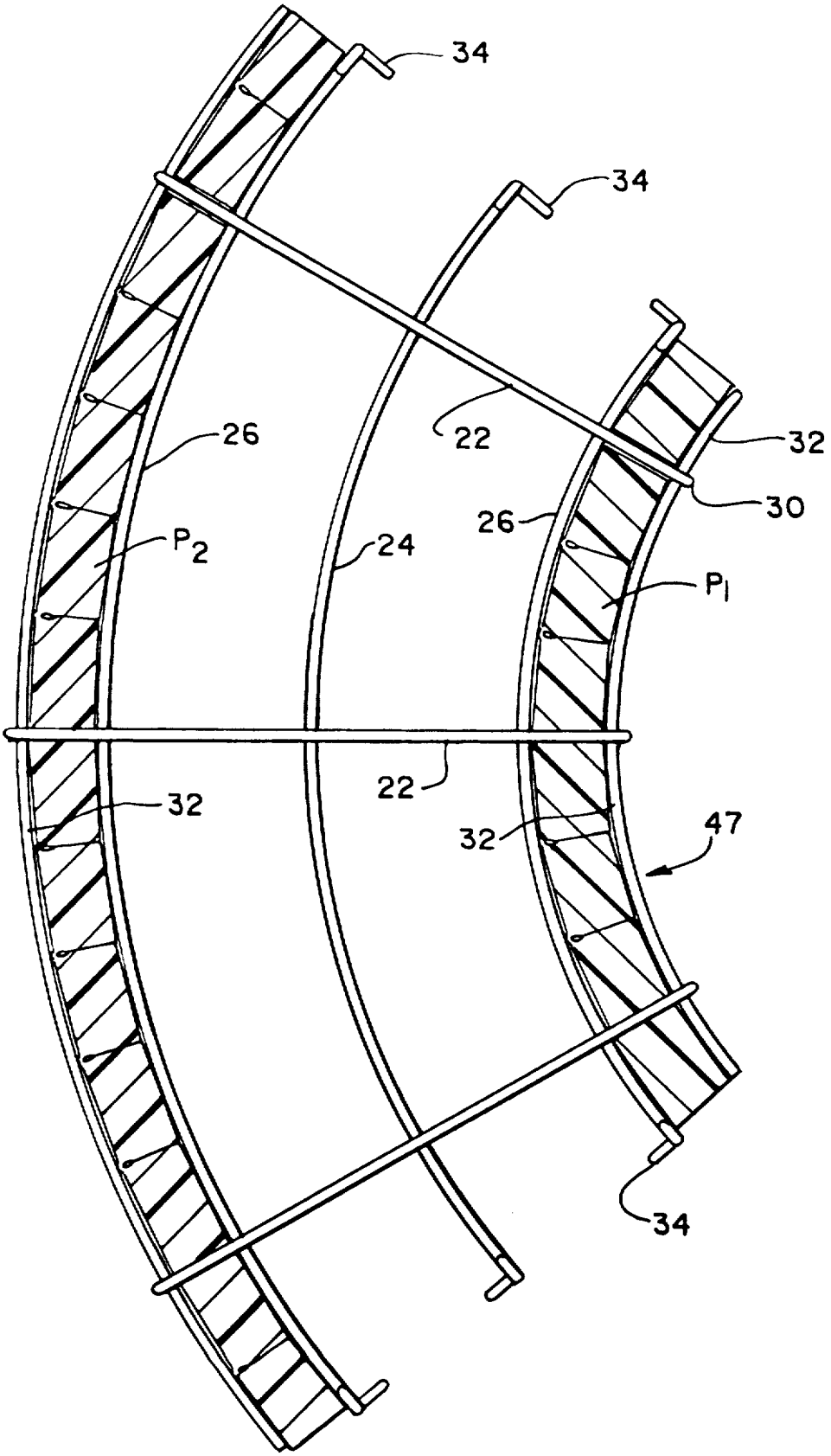
FIG. 12 is an enlarged horizontal cross-sectional view of a curved wall embodying the grid assembly of FIG. 11.

FIGS. 11 and 12 disclose a modified form unit 47 for use in forming walls having curved or non-planar configurations. Rods 24 and 26 are uniformly spaced and curved about a common center of curvature. Cross rods 22 are welded to rod 24 and 26 thereby maintaining the space uniformity of the latter. The cross rods have protruding reentrant portions which lockingly engage retaining rods 32; the latter in turn engaging the exterior surfaces of curved wall panels $P_1$, $P_2$. Rods 24 and 26 have hook-shaped ends 34 of the types previously described.

The wall panel foam has an inherent flexibility which will allow it to conform to gentle curves. Where, however, more severe curves are required, the foam at the exterior and interior surfaces can be grooved in order to attain the desired curvature. In the alternative, strips of the foam having a keystone cross-sectional configuration may be arranged in side by side relation and inserted between the rods 26 and the retaining rods 32 to form the wall configuration.

Multiple curved form units 47 may be utilized so as to form cylindrical or serpentine structures.

The improved concrete forming systems aforedescribed are lightweight readily portable to the job-site and may be easily and expeditiously set up with a minimal amount of manual labor. In addition the skeletal grid assemblies prevent voids from forming in the poured material once it has hardened. The improved system allows for on-sight tailoring of form dimensions for specific applications. The insulative properties of the wall panels in the improved system allow concrete to be poured during wintry climatic conditions.

What is claimed is:

1. A forming system for a hardenable material comprising at least one forming unit provided with upright spaced apart first and second wall panels, each panel being formed of a foam plastic material and having interior and exterior surfaces and having a plurality of holes extending therethrough, the holes in the first panel being laterally aligned with corresponding holes in the second panel, a skeletal grid assembly disposed between said wall panels for retaining same in said spaced-apart relation, said grid assembly including a plurality of laterally extending first rods spanning the distance between said wall panels, each first rod having reentrant end portions extending through laterally aligned holes whereby bail segments of the reentrant portions protrude outwardly from the wall panel exterior surfaces, said bail segments of each grid assembly being in lateral alignment, a plurality of second rods attached to at least some of said first rods, said second rods being disposed adjacent the interior surfaces of said wall panels, and a plurality of retaining means lockingly engaging the protruding segments of the reentrant portions, each of said retaining means engaging a plurality of said bail segments, and being disposed adjacent the wall panel exterior surfaces whereby each wall panel is firmly sandwiched between a predetermined second rod and a retaining means, said second rods including angularly offset end portions having notched portions, said angularly offset end portions adapted to interlock with selected portions of a second form unit disposed in proximate side by side relation with said one form unit.

2. The forming system of claim 1, wherein each retaining means includes an retaining rod perpendicularly disposed relative to said first rod and simultaneously interlockingly engaging the protruding segments of the reentrant portions of said first rods.

3. The forming system of claim 2, wherein said protruding segments comprise loops.

4. The forming system of claim 1 wherein the wall panels, the grid assembly, and retaining means of the one form unit are curved about a common center of curvature whereby the hardenable material deposited between the wall panels will form, when hardened, a wall having a predetermined curved configuration.

5. A forming system comprising at least a pair of form units arranged in side by side relation, each unit including spaced apart upright first and second wall panels of foam plastic material, each wall panel having interior and exterior surfaces, and a plurality of holes extending therethrough, said holes in one wall panel being laterally aligned with corresponding holes in the other wall panel; a skeletal grid assembly disposed between said wall panels for retaining same in said spaced apart relation, said grid assembly including a plurality of laterally extending first rods, each having reentrant end portions passing through corresponding laterally aligned holes, each reentrant portion having a bail segment thereof protruding outwardly from the panel exterior surface, said bail segments of each grid assembly being in lateral alignment, a plurality of spaced, longitudinally extending second rods attached to at least some of said first rods and disposed against the interior surfaces of said wall panels, said second rods including angularly offset end portions, the latter having notched portions for interlocking with corresponding offset end portions of the second form unit of the pair, and retaining means lockingly engaging the protruding bail segments of the reentrant portions of said first rods, each of said retaining means engaging a plurality of said bail segments, and being disposed against the exterior surfaces of said wall panels whereby each first wall panel is sandwiched between a second rod and said retaining means.

6. The forming system of claim 1 or 2, wherein said wall panels are of expanded polystyrene.

7. The forming system of claim 1 or 2, wherein said holes are pre-formed in said wall panels.

8. The forming system of claim 1 or 2, wherein a predetermined number of said rods are of metal wire.

9. The forming system of claim 1 or 2, wherein at least a longitudinally extending third rod is attached to at least some of said first rods and is disposed between said second rods.

10. The forming system of claim 9, wherein said third rod includes angularly offset end portions.

11. A forming system for a hardenable material comprising at least one forming unit having a pair of wall panels arranged in a predetermined upright spaced relation, said wall panels having exterior and interior surfaces, said interior surfaces being in opposed, spaced substantially parallel relation, and a skeletal grid assembly disposed between said wall panels for retaining same in said predetermined spaced relation while the hardenable material is deposited therebetween; said skeletal grid assembly including a plurality of elongate first means spanning the distance between the panel interior surfaces, each first means having end portions disposed within predetermined holes formed in said wall panels, each end portion having a segment thereof lockingly engaged by retaining means disposed adjacent the panel exterior surfaces, each of said retaining means engaging a plurality of said segments, a plurality of elongate second means disposed intermediate said wall panels and engaging the interior surfaces thereof, said second means being angularly disposed relative to said first means and affixed thereto, said second means having notched portions and angularly offset ends protruding beyond the periphery of said wall panels, adapted to interlock with selected portions of a second form unit disposed in proximate side by side relation with said one form unit.

12. The forming system of claim 11 wherein the notched portion of the offset ends of said second means are for interlockingly engaging corresponding notch portions of a grid assembly of a second unit of like construction whereby corresponding wall panel interior surfaces of the units are retained in substantially planar relation.

13. The forming system of claim 12 wherein the offset ends of said second means are hook-shaped.

14. The forming system of claim 13 wherein each hook-shaped end portion includes a notch portion.

15. The forming system of claim 14 wherein each notch portion is sized to accommodate a complementary notch portion or a first rod of a second unit of like construction whereby corresponding wall panels of the units are retained in abutting relation.

16. The forming system of claim 11 wherein opposite ends of the second means are offset at substantially the same angle.

17. The forming system of claim 16 wherein the opposite offset ends of the second means extend in different directions.

18. The forming system of claim 16 wherein the opposite offset ends of the second means extend in substantially the same direction.

19. A forming system for a hardenable material comprising at least one form unit provided with upright spaced apart wall panel assemblies, each panel assembly including a pair of panel sections formed of foam plastic material, each panel section having interior and exterior surfaces; a skeletal grid means disposed intermediate said wall panel assemblies, said grid means including a pair of end grid assemblies and an intermediate grid assembly interconnecting said end grid assemblies each end grid assembly being fixedly connected to corresponding panel sections of said spaced apart wall panel assemblies, said end grid assemblies being selectively slidable towards or away from each other independently of said intermediate grid assembly while maintaining said wall panel assemblies in a predetermined space relation; and auxiliary panel means insertable between corresponding panel sections of the end-grid assemblies when the latter have been selectively slid away from each other, said auxiliary panel means when in the inserted position having interior surfaces substantially coplanar with those of the adjacent wall panel sections.

20. The forming system of claim 19 wherein each end-grid assembly includes locking means protruding from a peripheral segment of said wall panel section remote from said intermediate grid assembly.

21. The forming system of claim 20 wherein the locking means includes at least one hook-shaped element.

* * * * *

UNITED STATES PATENT AND TRADEMARK OFFICE

CERTIFICATE OF CORRECTION

PATENT NO. : 5,140,794
DATED : August 25, 1992
INVENTOR(S) : Brian J. Miller

It is certified that error appears in the above-indentified patent and that said Letters Patent is hereby corrected as shown below:

On the title page, item (54) and Col. 1, "Hardening" should read -- Hardenable--.

Col. 2, line 3, after "each" insert --grid--

Col. 3, line 1, after "Fig. 8" insert --is--

Col. 6, line 9, change "21" to --21r--

In the claims, Col. 7, line 15, after "an" insert --elongate--

Signed and Sealed this
Ninth Day of November, 1993

Bruce Lehman

*Attest:*

BRUCE LEHMAN

*Attesting Officer*

*Commissioner of Patents and Trademarks*